US007055433B1

(12) United States Patent
Leimand

(10) Patent No.: US 7,055,433 B1
(45) Date of Patent: Jun. 6, 2006

(54) METHOD OF OPERATION OF A PRINTING UNIT AND PRINTING UNIT FOR OFFSET MACHINE

(75) Inventor: Henrik Leimand, Bjert (DK)

(73) Assignee: Tresu A/S, Bjert (DK)

( * ) Notice: Subject to any disclaimer, the term of this patent is extended or adjusted under 35 U.S.C. 154(b) by 0 days.

(21) Appl. No.: 09/446,991

(22) PCT Filed: Jul. 2, 1998

(86) PCT No.: PCT/DK98/00303

§ 371 (c)(1),
(2), (4) Date: Feb. 4, 2000

(87) PCT Pub. No.: WO99/01282

PCT Pub. Date: Jan. 14, 1999

(30) Foreign Application Priority Data

Jul. 3, 1997 (DK) ..... 0800/97

(51) Int. Cl.
*B41F 1/34* (2006.01)
*B41L 23/00* (2006.01)

(52) U.S. Cl. ..... 101/485; 101/144; 101/147

(58) Field of Classification Search ..... 101/147, 101/148, 137, 139, 140, 142, 143, 144, 217, 101/423, 425, 483, 484, 485
See application file for complete search history.

(56) References Cited

U.S. PATENT DOCUMENTS

| | | | | |
|---|---|---|---|---|
| 4,308,796 | A * | 1/1982 | Satterwhite | 101/143 |
| 4,432,282 | A * | 2/1984 | Jurinak | 101/350.5 |
| 4,722,273 | A * | 2/1988 | Jahn | 101/142 |
| 6,116,158 | A * | 9/2000 | DeMoore et al. | 101/177 |

FOREIGN PATENT DOCUMENTS

| | | |
|---|---|---|
| DE | 3500437 | 10/1985 |
| EP | 0350839 | 1/1990 |
| EP | 0574124 | 12/1993 |
| EP | 0659557 | 6/1995 |
| EP | 0767058 | 4/1997 |
| GB | 2119711 | 11/1983 |
| GB | 2184982 | 7/1987 |

* cited by examiner

*Primary Examiner*—Ren Yan
(74) *Attorney, Agent, or Firm*—Jenkens & Gilchrist, P.C.

(57) ABSTRACT

There is disclosed a printing unit (1) for use in an offset machine. The printing unit allows a broader use of offset machines (1). This is achieved in that the lacquer application means and the water application means comprise a unit (28) consisting of a doctor blade chamber device (30) and at least one roller (29, 32) for transferring lacquer or water from the doctor blade chamber device (30) to the plate cylinder (15) of the printing unit.

2 Claims, 6 Drawing Sheets

METHOD OF OPERATION OF A PRINTING UNIT AND PRINTING UNIT FOR OFFSET MACHINE

The present invention relates to a method of operation of a printing unit and a printing unit for use in an offset machine comprising lacquer application means and water application means.

BACKGROUND OF THE INVENTION

Offset machines are known in the art and therefore will only be briefly explained. A web or a sheet to be printed is passed between printing rollers or transfer rollers. The web or the sheets are made to abut on a blanket cylinder for application of the print to be applied in the individual printing unit in the offset machine. The blanket cylinder is in contact with a plate cylinder which transfers the colour print which is to be placed on the web. The plate cylinder is in contact with dampening unit and an inking unit applying damp and ink, respectively. Thus, an offset plate on the plate cylinder will be rotated whereby water receptive parts are dampened by the rollers of the dampening unit. Then the ink receptive parts of the offset plate are provided with ink from the inking rollers in the inking unit. The formed image is then applied to the blanket cylinder which in turn applies the ink onto the web or the sheet. Preferably a paper web is used, but other materials may also be used for printing.

A printing unit according to the present invention may be used in a traditional offset machine, for example of the type disclosed in EP 767.058. The contents of this patent application is hereby incorporated by reference, as the printing unit may form a part of an offset machine constructed according to the same principle and with the same sheet feeder and sheet delivery means at the beginning and the end of the printing unit, just like there may be used similar means for transferring paper web or sheets between different, consecutive printing units to apply the finished image to the web. Likewise, the same type of printing ink may be employed. Offset machines may be equipped with a lacquering unit. The lacquering unit will typically be constructed with a plate cylinder onto which the lacquer is applied from a roller arrangement which is supplied from a pan with clear lacquer.

SUMMARY OF THE INVENTION

It is the object of the present invention to provide a method of operation of a printing unit and a printing unit for an offset machine allowing a broader use and a more effective operation of printing units in existing offset machines. Furthermore, it is an objet to provide a printing unit which simultaneously may be used for application of lacquer and ink in the same printing unit.

According to the present invention this is achieved with a method characterised in that the printing unit comprising a doctor blade chamber device is used for lacquer application and as a dampening unit for water application.

The printing unit for use by the method is characterised in that the lacquer application means and the water application means are comprised of a unit comprising a doctor blade chamber device and at least a roller for transferring lacquer or water from the doctor blade chamber device to the plate cylinder of the printing unit.

By using such a method and such a unit, it becomes possible to modify existing offset machines such that they find a broader use and simultaneously the process may run faster. The amount of ink or damp located in the holes on the transfer roller will be transferred to the plate cylinder either directly or via a rubber roller.

It will be possible to use separate doctor blade chamber devices for lacquer application or water application. However, it will also be possible to use one and the same doctor blade chamber device for lacquer or water application.

In a lacquering unit, which typically will be the last printing unit in an offset machine, it is advantageous that the lacquer application means comprises only one screen roller in the form of an anilox roller for transferring the lacquer applied directly from the doctor blade chamber device to the plate cylinder. This construction may be further developed. According to a special embodiment, most printing units will be provided with a support for supporting a cleaning system comprised of a liquid spraying nozzle and wiping paper. This system may be detachably mounted on the support. According to an advantageous embodiment, this support may also be used for supporting the lacquer application means in the form of the doctor blade chamber device and the screen roller. In such a situation, the screen roller will preferably be driven by its own motor, preferably a tacho motor. Thus, the coupling means located in the frame of the offset machine can be reused as coupling means for the unit according to the invention.

The motor which is being used to drive the screen roller is an independent motor in order to be able to adjust the number of revolutions for different offset machines. Thus, the unit does not require a special adjustment of the drive of the screen rollers for different offset machines. In the machine, all that is required is a suspension which in its most simple form comprises four pins or screws on a support.

By use of a unit according to the invention based on a doctor blade chamber device, it will be possible to apply strongly pigmented inks, as for example metal lacquer. This will not be possible with conventional printing units, as pigments/inks will clot and make quality printing impossible.

The unit according to the invention may also be used as a dampening unit. In the known dampening units an environmental problem arises. To transfer the dampening water with the present roller arrangement, it is necessary to add solvents. At present, this has been prohibited in several places.

Alternatively, attempts have been made to solve the problem by using Teflon coating to form a sort of mask so as to avoid ink setoff in certain areas. This is known as dry offset and, in principle, is a different process. Thus, Teflon may be used to replace water application from the dampening rollers. This system has an advantage as the paper is not dampened and so there is no risk of poor attachment of lacquer.

Instead of using the traditional dampening units, according to the present invention a system comprising a doctor blade chamber device and a transfer roller may be used. According to a preferred embodiment, a screen roller and a rubber roller are used between the doctor blade chamber device and a plate cylinder. This is advantageous as it allows a faster printing than previously. The amount of water or the water bead which is being formed in a wedge-shaped space between the rubber roller and the plate cylinder can be varied by operating at varying speeds between the rubber roller and the plate cylinder. By operating the rubber roller at a greater speed, it is thus possible to provide a greater amount of water in the wedge. The amount of water can also be adjusted by varying the clearance of the rubber roller and the plate cylinder. The printing unit according to the invention is thus advantageous in that the amount of water located in the clearance may be varied according to need.

As a printing unit is intended either for lacquer or as dampening unit, it will be possible to use same unit comprising a doctor blade chamber device and transfer roller for both water and for lacquer.

If the plate cylinder is provided with rubber blanket, it will be possible to place cardboard under the blanket wherein a so-called window is made, i.e. an area which is cut out. Hereby, no print is made in this area. This provides the possibility of the finished image being provided with a blank space in this area, for example for a bar code or for adhesive.

By use of a conventional dampening unit, it will not be possible to apply lacquer. Because of the surface rates, there will be a substantial and unacceptable pollution of the surroundings as lacquer will splash from the periphery of the roller and from the ends of the rollers. By using the unit according to the invention as dampening unit, it will be possible to avoid pollution.

It will also be possible that two units according to the invention are provided together with the plate cylinder, of which the one unit is used for lacquer application and the other for water application. Hereby it will be possible to provide lacquer stripes and ink stripes side by side on the plate cylinder. This is made possible as doctor blade chamber devices can be divided to supply liquid/ink over a part of their length. Thus, hereby is achieved the possibility of making prints with entirely new effects.

In traditional offset machines more printing units will usually be provided. There have been a growing need and a desire to be able to employ lacquer application on the formed colour prints. Lacquer application is used as a final layer providing a lacquer layer atop the formed colour print. This lacquer application yields a better quality and a greater depth in the formed print. If it is desired to be able to apply lacquer, it has been necessary to supplement the traditional offset machines with an extra lacquering unit. The lacquering unit normally has a structure which is comparable to that of a dampening unit. This means that the lacquering unit transfers lacquer from a lacquer reservoir via a roller arrangement and a contact roller which abuts on the plate cylinder.

With the present invention it is possible to modify one or all of the desired printing units. The one or all the printing units which are not rebuilt are used for offset-printing. It is, for example, possible to modify an existing offset machine with four printing units. This may take place by modifying the last printing unit in the operating direction of the machine. The three preceding printing units then use the primary colours to make of the desired colour print. In the one or all of the modified printing units, the offset inking unit is detached from the plate cylinder. Then the cleaning system is replaced by a unit comprising a doctor blade chamber device and a screen roller which is moved into engagement with the blanket cylinder which will then act as a plate cylinder. In this system, the plate cylinder will be provided with a rubber blanket which is in contact with the hard screen roller. If, at a later time, it is desired not to use lacquer application, it will be possible to demount the unit comprising the screen roller and the doctor blade chamber device and re-mount the rollers of the dampening unit.

If frequent changes are required, it will be possible to place the dampening unit and a unit comprising the screen roller/doctor blade chamber device on a slide system such that these two systems optionally may be moved into and out of engagement with the plate cylinder. By the conversion from lacquer operation to conventional inking operation and vice versa in such a printing unit, it will thus be necessary to exchange the plate on the plate cylinder as a rubber blanket is used when the lacquering unit is in engagement, whereas conventionally a metal plate is used when the dampening unit and the inking unit are in engagement with the plate cylinder.

BRIEF DESCRIPTION OF SEVERAL VIEWS OF THE DRAWINGS

The invention will now be described in detail with reference to the accompanying schematic drawing, in which.

DETAILED DESCRIPTION OF THE INVENTION

Figure 1:
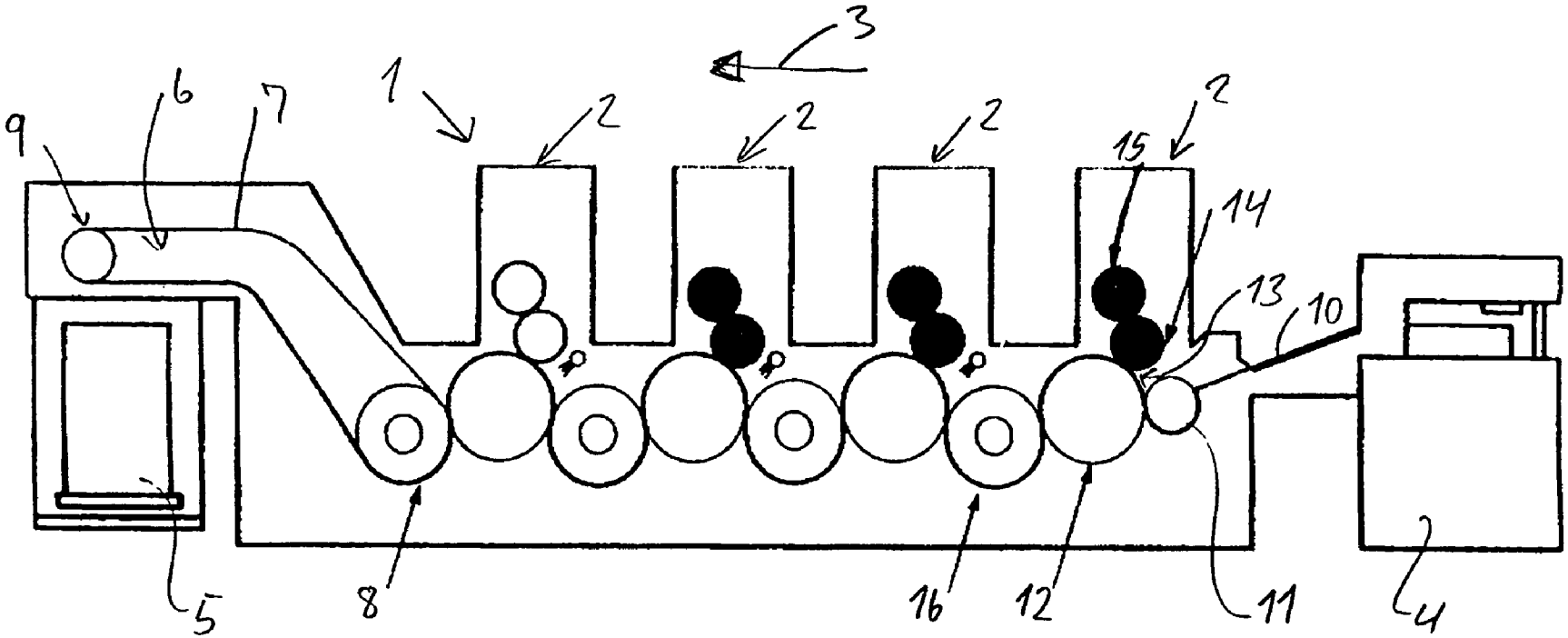
FIG. 1 shows a side view of a typical offset machine comprising four printing units.

FIG. 1 shows a traditional offset printing machine 1 comprising four printing units 2. The machine has a transport direction 3 for sheets being printed. The sheets come from a feeder station 4 and is transferred to a delivery station 5 by means of a feeder arrangement 6 comprising a conveyor belt 7. The conveyor belt 7 extends around two rollers 8,9. The individual sheets are transferred from the unit 4 via a track 10 around an impression cylinder 12. The individual sheets are placed at a position indicated by 13. Thus, the sheets are placed in an area between a blanket cylinder 14 and an impression cylinder 12. The blanket cylinder 14 is in contact with a plate cylinder 15. Apart from the impression cylinders 12, the offset machine also comprises transfer cylinders 16 for the sheets.

Furthermore, the offset machine comprises gripper means for holding the sheets and a plurality of rollers for dampening units and inking units which are connected to the plate cylinder. As these are well known, they are not shown in FIG. 1 which serves to illustrate the construction of the offset unit. However, these rollers are shown in FIG. 2.

Figure 2:
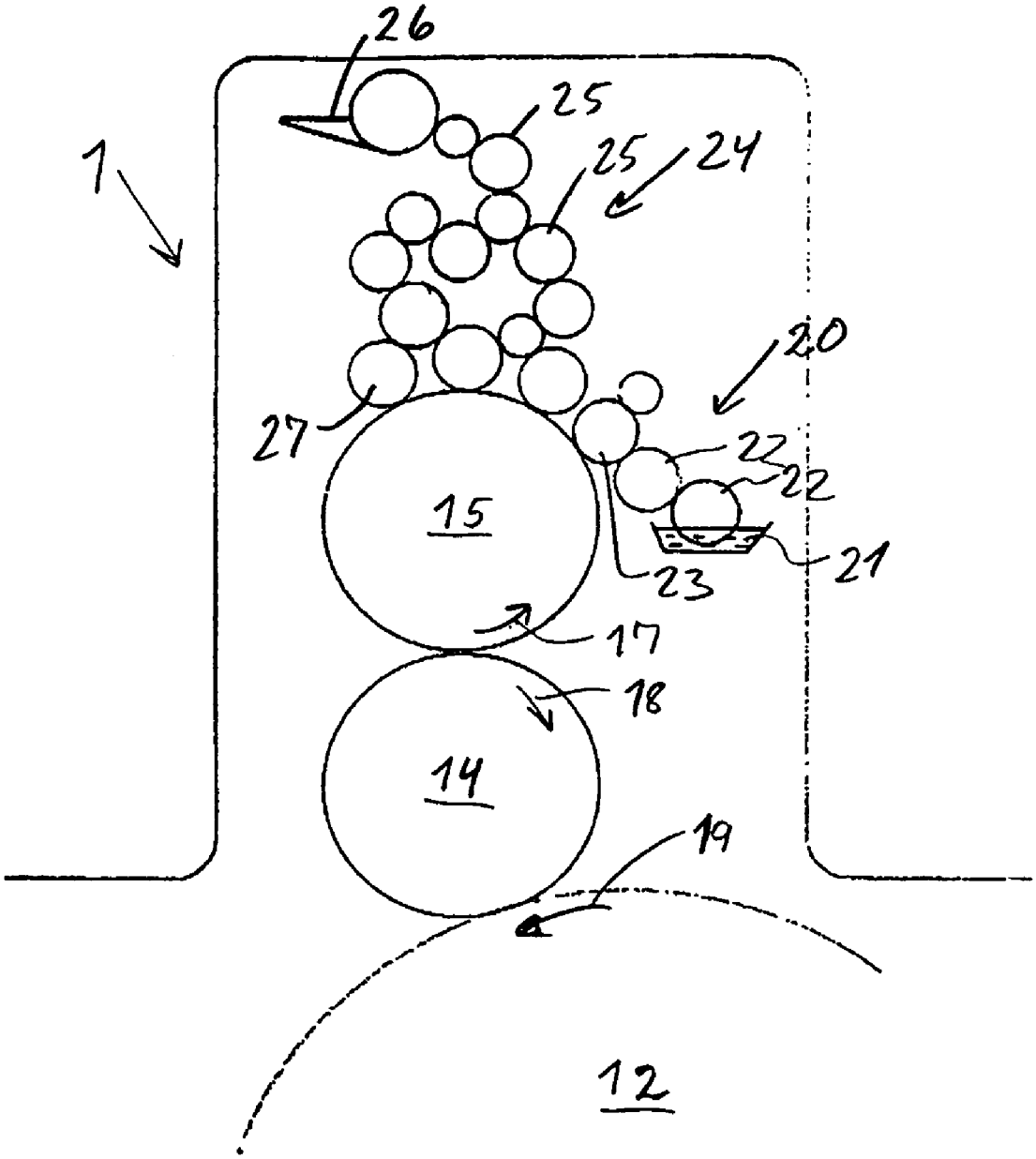
FIG. 2 shows a partial view illustrating a known printing unit comprising a dampening unit and an inking unit.

FIG. 2 shows a printing unit 1 comprising an impression cylinder 12, a blanket cylinder 14 and a plate cylinder 15. These cylinders rotate according to the arrows 17,18,19. A dampening unit comprises a container 21 for water. From the water container 21 the water is led via a system of rollers 22 to the last contact roller 23 abutting on the plate cylinder 15. Furthermore, the printing unit 1 comprises an inking unit 24 comprising a number of rollers 25 which transfer ink from an ink fountain 26 to contact rollers 27 applying the ink to a plate (not shown) located on the plate cylinder 15. Thus, the plate which is located on the plate cylinder will be supplied with ink in the areas to which no water has been applied from the dampening unit 20. The plate will usually be an etched metal plate.

As an inking unit, in principle, is constructed like the dampening unit 20, FIG. 2 can also be said to illustrate an inking unit. Thus, the ink will be fed from the container 22 containing lacquer and be transferred via rollers 22 to the last contact roller 23 also called the forme inking roller.

The shown embodiment possesses certain environmental and technical disadvantages. Instead of using the existing dampening unit, the printing unit shown in FIG. 2 can be modified as illustrated in FIG. 3.

Figure 3:
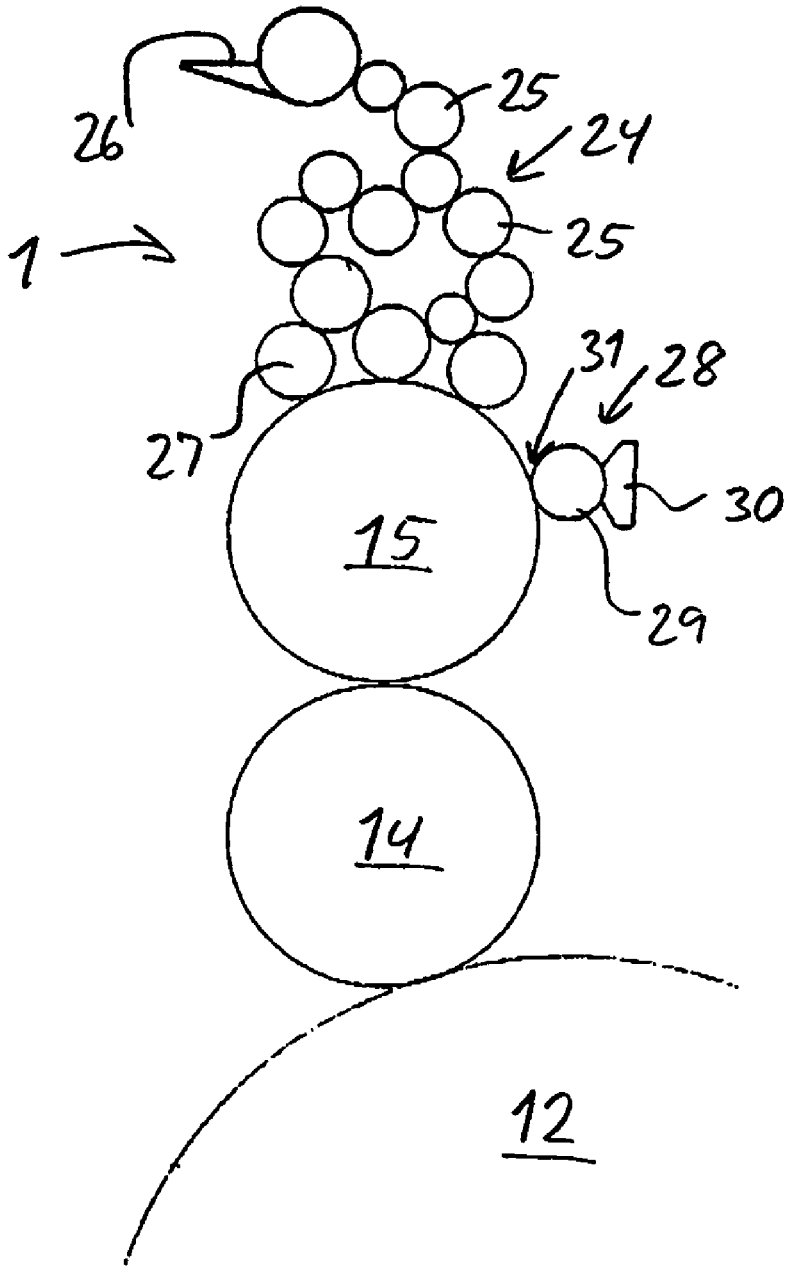
FIG. 3 shows a view corresponding to FIG. 2 illustrating a first embodiment of a printing unit according to the invention.

In FIG. 3 the contact roller 23 is replaced by a unit 28 comprising a screen roller 29, preferably an anilox roller, of the kind used in flexographic printing. The screen roller 29 may be mounted directly in the existing suspension. On the screen roller 29, a doctor blade chamber device 30 is mounted. Even at large peripheral rates, the unit 28 can ensure a constant and uniform amount of water and/or lacquer being transferred to the plate cylinder 15. If it is desired to use the unit 28 for lacquer application, the rollers 27 of the inking unit are moved out of engagement with the plate cylinder 15. If the unit 28 is used for water application, the inking unit 24 is maintained in engagement with the plate cylinder 15.

In the shown embodiment, the use of the hard screen roller 29 will necessitate the use of a rubber blanket on the plate cylinder 15.

The shown printing unit will be very simple and easy to maintain. Simultaneously, the system will be easy to convert depending on whether it is desired to use the printing unit for one purpose or the other. Thus, according to ones wishes, it will be possible to use the existing dampening unit concurrently with the unit 28 according to the invention.

When the unit 28 is used for water application, it will be easy to adjust the amount of water in a simple manner. Such an adjustment of the amount of water is difficult in traditional dampening units where the rollers run synchronously with the plate cylinder 15. The screen roller 29 may be provided with its own motor driven independently of the plate cylinder. This provides the possibility of a differentiated peripheral rate and thereby the possibility of damming up larger or smaller amounts or water in the wedge-shaped space 31 formed between the screen roller 29 and the plate cylinder 15.

Figure 4:
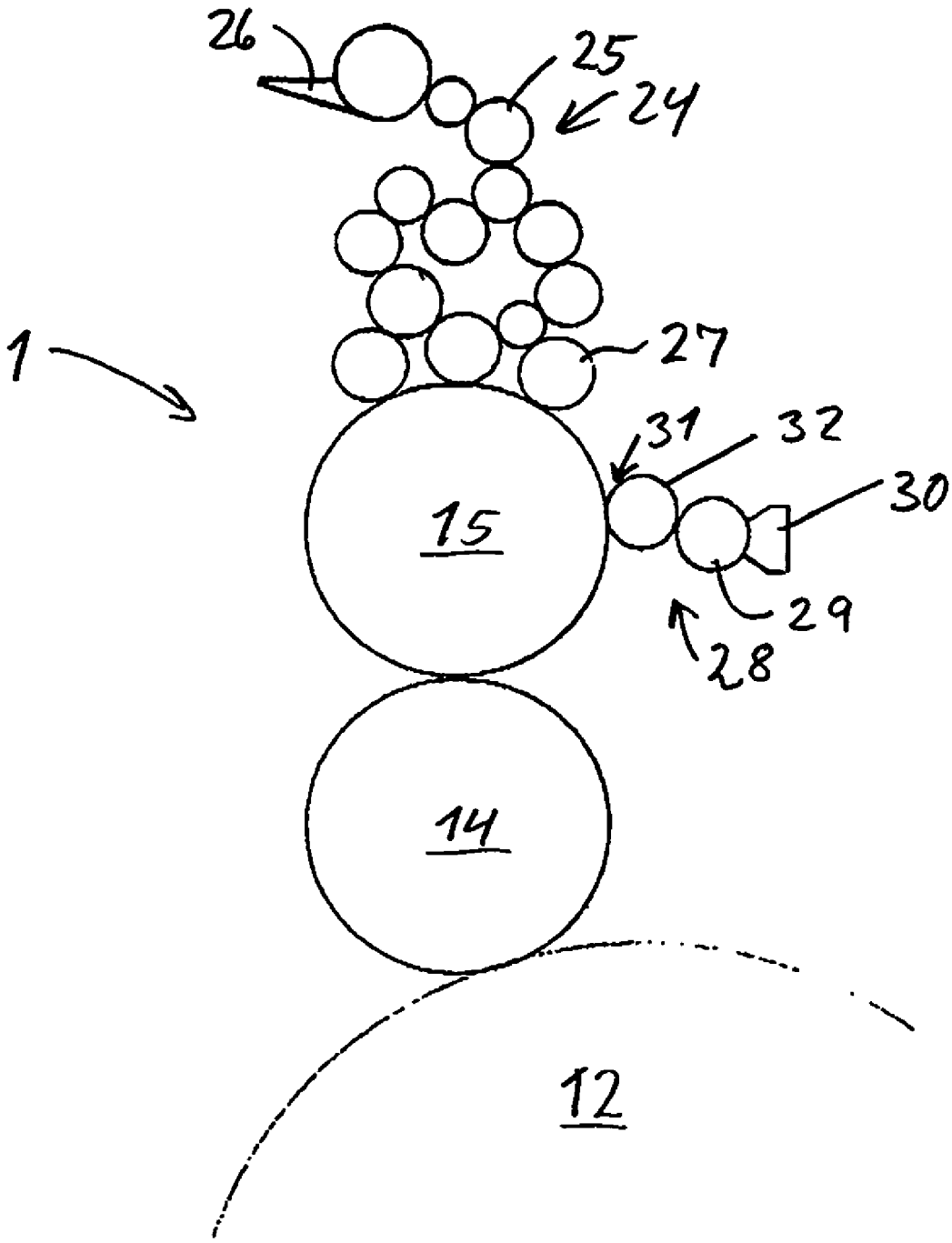
FIG. 4 shows a view corresponding to FIG. 2 illustrating a second embodiment of an printing unit according to the invention.

In FIG. 4, there is shown a further embodiment of a printing unit 1 according to the invention. FIG. 4 differs from the printing unit shown in FIG. 3 in that between the unit 28 there is placed a further roller, viz. a rubber roller 32. By using a dampening unit constructed according to this principle, the dampening water will be transferred to the plate cylinder 15 from the doctor blade chamber device 30 via the screen roller 29 to the rubber roller 32 which will apply the dampening medium/water onto the plate cylinder 15. This arrangement is particularly advantageous with the opportunity for speed variation. Thus, the peripheral rate in this embodiment may easily be varied relative to the peripheral rate on the plate cylinder with regard to varying the damp supply according to wish. In the embodiment shown in FIG. 4, the plate cylinder 15 can be used with a traditional metal plate whereto the ink is applied in the inking unit 24.

Figure 5:
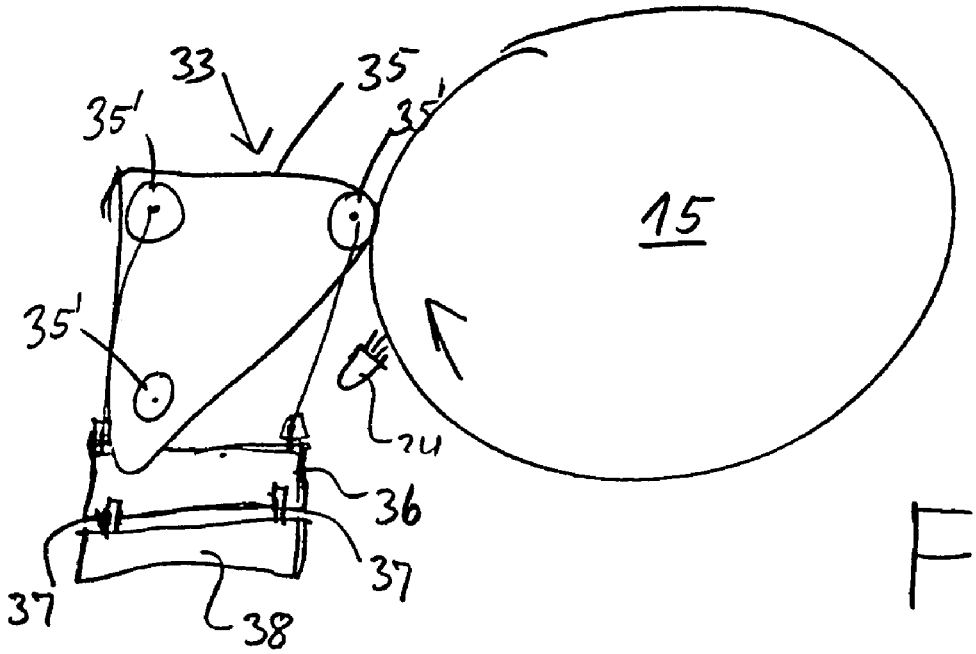
FIG. 5 shows an example of a known arrangement in a printing unit.

In FIG. 5 there is shown a known cleaning arrangement 33 to be used for a blanket cylinder 14 which act as a plate cylinder as the plate cylinder in the off-set machine is detached. The cleaning arrangement 33 comprises a liquid nozzle 34 which sprays a liquid onto the plate cylinder and onto a wiping belt 35 extending around the roller 35'. The rollers 35' and the nozzle 34 are mounted on a support 36. The support 36 is mounted on pins 37 fastened to the frame 38 of the offset machine.

Figure 6:
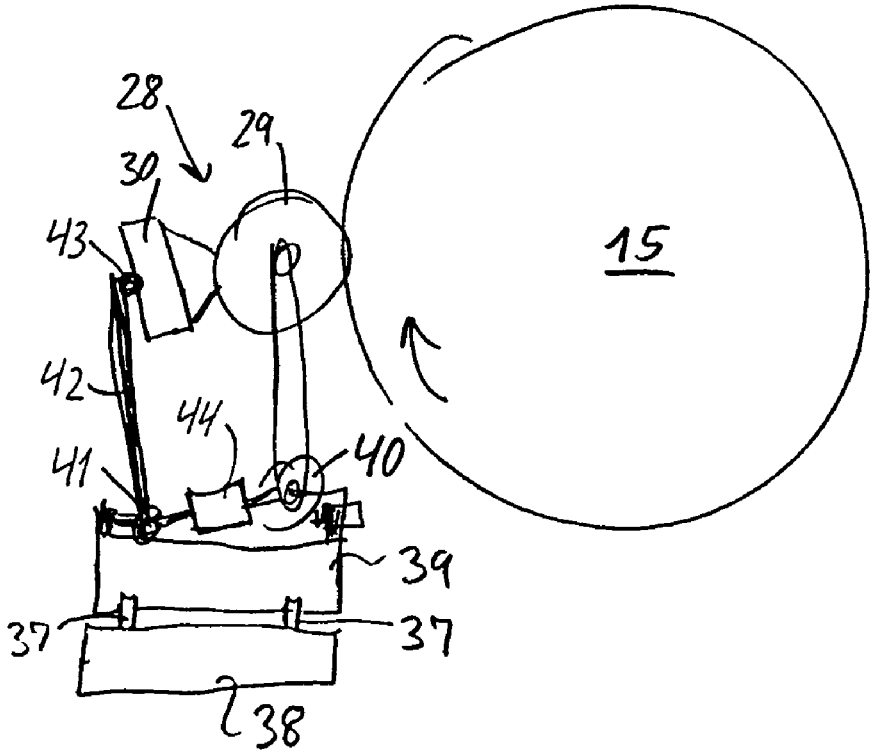
FIG. 6 shows a view corresponding to FIG. 5 illustrating a further embodiment of a printing unit according to the invention.

The arrangement 33 may be secured to the pins 37 by bolts or in another way. However, the arrangement is detachable from these pins. Thus, it will be possible to replace the shown arrangement by a unit illustrated in FIG. 6 and comprising a doctor blade chamber device 30 and a screen roller 29. The unit 28 is mounted on a supporting frame 39. The supporting frame 39 is mounted on the frame 38 of the machine via the pins 37. Thus, it is easy to substitute the unit 28 for the device 33.

The roller 29 is driven by its own motor 40 by means of a belt connection or another suitable transmission connection. The motor 40 is preferably a tacho motor, such that the rotational speed can be set according to wish and adjusted to the rotational speed of the plate cylinder 14. The unit 28 is pivotally mounted about a bearing 41, such that it may be pivoted out of and into engagement with the cylinder 14. The doctor blade chamber device 30 is mounted on an arm 42 via a pivotal bearing 43 such that it can be adjusted to the screen roller 29. The mutual swinging of the system may be established by means of a cylinder 44.

Figure 7:
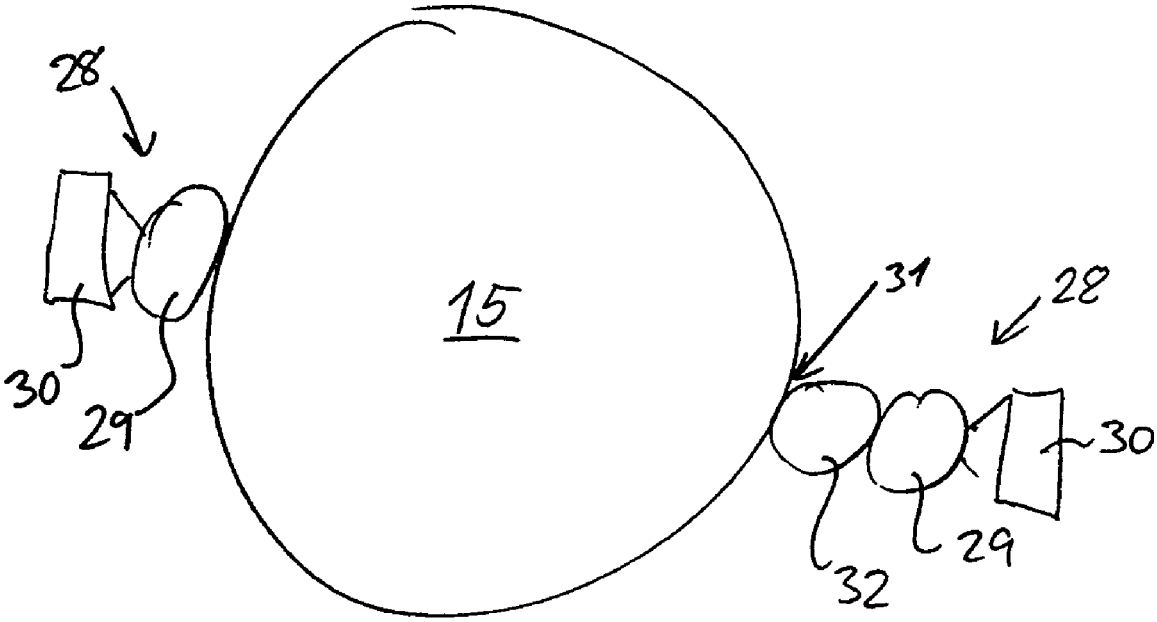
FIG. 7 shows a view illustrating a further embodiment of a printing unit according to the invention.

FIG. 7 shows a further embodiment of a printing unit according to the invention. In this printing unit, there is a simultaneous use of two units 28. In this embodiment, there is not shown an inking unit 24 corresponding to the inking unit 24 in FIGS. 2,3 and 4. However, such an inking unit will also form part of this embodiment. The unit 28 illustrated to the right in the Figure, is used for the application of damp. The unit 28 illustrated to the left is used for the application of lacquer. As it is possible to divide the doctor blade chamber device across its length, it will be possible to apply lacquer in stripes where the dampening unit does not apply damp. Such an effect will not be possible in traditional printing units. The inking unit and the dampening unit illustrated in FIG. 7 will work according to the same principle as explained above with reference to the preceding Figures.

The invention claimed is:

1. A method of operating a printing unit in an offset machine, which includes a plate cylinder and an inking unit which is movable to engage and disengage said plate cylinder, the method comprising the steps of:

providing a doctor blade chamber device and a screen roller which operates as both a lacquer applying unit and a dampening unit for alternately applying lacquer and alternately applying water;

disengaging the inking unit from contact with said plate cylinder when said doctor blade chamber device is applying lacquer;

engaging the inking unit to be in contact with said plate cylinder when said doctor blade chamber device is applying water; and wherein lacquer is applied to the plate cylinder by direct contact of the screen roller with said plate cylinder, said screen roller adapted to receive the lacquer from the doctor blade chamber device.

2. A method of operating a printing unit in an offset machine which includes a plate cylinder and an inking unit which is movable to engage and disengage said plate cylinder, the method comprising the steps of:

providing a first doctor blade chamber device and a screen roller which operates as a lacquer applying unit for applying lacquer;

providing a second doctor blade chamber device which operates as a dampening unit for applying water;

disengaging the inking unit from contact with said plate cylinder when said first doctor blade chamber device is applying lacquer;

engaging the inking unit to be in contact with said plate cylinder when said second doctor blade chamber device is applying water; and applying lacquer to the plate cylinder by direct contact of the screen roller with said plate cylinder, said screen roller adapted to receive the lacquer from the first doctor blade chamber device.

* * * * *